US009918544B2

(12) United States Patent
Jannaschk

(10) Patent No.: US 9,918,544 B2
(45) Date of Patent: Mar. 20, 2018

(54) BRUSH ASSEMBLY

(75) Inventor: Volker Jannaschk, Koenigswinter (DE)

(73) Assignee: MONTI-WERKZEUGE GMBH, Hennef (DE)

( * ) Notice: Subject to any disclaimer, the term of this patent is extended or adjusted under 35 U.S.C. 154(b) by 1160 days.

(21) Appl. No.: 13/825,560

(22) PCT Filed: Sep. 23, 2011

(86) PCT No.: PCT/EP2011/066602

§ 371 (c)(1),
(2), (4) Date: Jun. 20, 2013

(87) PCT Pub. No.: WO2012/038537

PCT Pub. Date: Mar. 29, 2012

(65) Prior Publication Data

US 2014/0299153 A1 Oct. 9, 2014

(30) Foreign Application Priority Data

Sep. 24, 2010 (DE) ..... 10 2010 046 398

(51) Int. Cl.

| | |
|---|---|
| ***A46B 13/00*** | (2006.01) |
| ***A46B 15/00*** | (2006.01) |
| ***B24B 29/00*** | (2006.01) |
| ***B24B 39/00*** | (2006.01) |
| ***B24D 13/10*** | (2006.01) |
| ***A46B 17/06*** | (2006.01) |
| *A46B 17/00* | (2006.01) |

(52) U.S. Cl.

CPC ..... *A46B 13/001* (2013.01); *A46B 15/0016* (2013.01); *A46B 17/06* (2013.01); *B24B 29/005* (2013.01); *B24B 39/003* (2013.01); *B24D 13/10* (2013.01); *A46B 17/00* (2013.01); *A46B 2200/3093* (2013.01)

(58) Field of Classification Search

None

See application file for complete search history.

(56) References Cited

U.S. PATENT DOCUMENTS

2005/0241085 A1* 11/2005 Montabaur ..... A46B 13/001 15/21.1
2006/0021166 A1* 2/2006 Hills ..... A46B 13/005 15/23
2007/0209126 A1* 9/2007 Montabaur ..... A46B 13/001 15/21.1

FOREIGN PATENT DOCUMENTS

JP 2001334453 B 12/2001

* cited by examiner

*Primary Examiner* — Michael Wieczorek
*Assistant Examiner* — Pradhuman Parihar
(74) *Attorney, Agent, or Firm* — Andrew Wilford

(57) ABSTRACT

The present invention relates to a brush unit (3) and to an associated rotary brush tool. The brush unit (3) is equipped with a brush holder (10, 11), which can be driven in rotation, and with an annular brush (4, 5) with a bristle-covered rim (8) with outwardly protruding bristles (5). Furthermore, a stop means (14) which dips into the rotating bristle-covered rim (8) is provided. According to the invention, the stop means (14) simultaneously acts as an abrasive body (14) for the bristles (5). In this case, a distinction is made between both functions (stopper function and abrasive function) according to a direction of rotation (R) of the annular brush (4, 5) and/or a setting position of the stop means (14) as compared to the bristle-covered rim (8).

8 Claims, 5 Drawing Sheets

BRUSH ASSEMBLY

CROSS REFERENCE TO RELATED APPLICATIONS

This application is the US-national stage of PCT application PCT/EP2011/066602 filed 23 Sep. 2011 and claiming the priority of German patent application 102010046398.1 itself filed 24 Sep. 2010.

FIELD OF THE INVENTION

The invention relates to a brush assembly comprising a rotatable brush holder and an annular brush with a bristle-covered rim having outwardly projecting bristles and comprising stop means that dips into the rotating bristles on the rim.

BACKGROUND OF THE INVENTION

In a brush assembly having the structure described initially in accordance with EP 1 834 733 [US 2007/0209126], the procedure is adopted that the bristles are braked for a certain time with the aid of the stop means. After release of the bristles by passing the stop means, the kinetic energy hereby stored in the bristles and/or a brush strip, can be used. This is used for additional beating processing of a surface of a material with the aid of the bristles. As a result, comparable effects such as is observed in so-called sand blasting are achieved. However, the previously described teaching manages without blasting means so that expenditure on installation technology is significantly reduced, environmental contamination is avoided and it is possible to work particularly cost-effectively and efficiently. This has proved successful.

In addition, a brush assembly without stopping means has become known from EP 1 591 037 [US 2005/0241085] that is equipped with an abrasive body. The abrasive body can be adjusted against the annular brush or against the bristles attached to this and specifically on its rear side when viewed in the working direction. In this way, a relief grinding of the bristles takes place with the aid of which blunted bristle tips can be reground. As a result, the desired roughness depths on a surface to be processed can be easily adjusted and also retained. This prior art has also proved fundamentally successful.

In a rotary brush tool according to EP 1 834 733 having stop means, it is now desirable to additionally attach an abrasive body as described in EP 1 591 037 A2 in order to combine the positive effects of the stop means with the possibility of regrinding the bristles. However, this results in a relatively prominent and impracticable structure. This is where the invention begins.

OBJECT OF THE INVENTION

The object of the invention is to further develop such a brush assembly such that the possibility for abrasive treatment of the bristles is additionally provided and specifically in a constructively simple and cost-effective structure.

SUMMARY OF THE INVENTION

In order to attain this object, a brush assembly as described above is characterized within the framework of the invention in that the stop means is at the same time configured as an abrasive body for the bristles, and a distinction is made between the two functions, that is between the stopper function and the abrasive function according to a direction of rotation of the annular brush and/or a setting position of the stop means as compared to the bristle-covered rim.

Within the framework of the invention, therefore in addition to the obligatory stop means, initially no additional abrasive means is used but the stop means is at the same time configured as an abrasive body for the bristles. The stop means substantially takes on the same function as has been described in EP 1 834 733 B1. This is because the bristles are braked for a certain time with the aid of the stop means so that after their release (by the stop means), the kinetic energy thereby stored is used for the additional beating treatment of a surface of a material by the bristles.

In addition to this stopper function, the stop means at the same time takes on an abrasive function. Within the framework of this abrasive function, the bristles undergo an abrasive treatment. In this case, usually but not restrictively the procedure is adopted that the bristles undergo a relief-grinding treatment on their rear side when viewed in the working direction with the aid of the abrasive body of the stop means. In fact the stop means is advantageously configured within the framework of the invention so that different surface regions of the stop means are responsible for the different functions described.

That is, the surface of the stop means predominantly has a stopper region and an abrasive region. The abrasive region can be designed or configured here so that this reliably carries out its abrasive function by abrasive particles, for example, of diamond, corundum or comparable abrasive bodies applied to the stop means. Naturally the abrasive region can also be defined at or on the stop means such that the stop means is particularly roughened in the abrasive region or undergoes a special surface treatment. In any case, the abrasive region is configured so that it is particularly suitable for the abrasive treatment of the bristles and here usually the bristle tips. The invention starts from the discovery that the bristles and in particular the bristle tips become "blunt" after a certain treatment time and must be "sharpened" again.

The abrasive region of the stop means according to the invention is available for this purpose. Here the procedure is usually adopted that the bristles in the region of their bristle tip undergo a relief-grinding treatment with the aid of the abrasive region on the stop means. This relief-grinding treatment takes account of the fact that the removal of material at the bristle tip is reduced to a minimum and nevertheless, a desired tip formation can be achieved. Here the invention starts from the fact that the bristles or their bristle tips are in any case more severely worn at their front flank due to the impacting treatment of the surface of the material compared with the rear flank. When the rear flank now undergoes the abrasive treatment described, the invention thus takes particular account of this fact. The treatment of the rear flank merely means that the bristles (at their bristle tip) undergo the relief-grinding treatment described with the aid of the abrasive region of the stop means on their rear side when viewed in the working direction.

In order to now be able to distinguish between the stopper function described and the abrasive function and to ensure that the bristles on the one hand interact with the stopper region and on the other hand with the abrasive region of the stop means, two different approaches are fundamentally feasible. First, switching between these two functions, i.e. the stopper function and the abrasive function, can be done when the annular brush changes its direction of rotation. In fact, the annular brush can rotate substantially in the clockwise direction or in the counterclockwise direction. One of the directions of rotation now corresponds on the one hand to the stopper function and on the to the abrasive function of the stop means. For example, rotation of the annular brush in the counterclockwise direction may belong to the stopper function. On the other hand, rotation of the annular brush in the clockwise direction has the result that the stop means assumes its abrasive function. In this case, the stop means will in principle be placed so that it dips into the rotating bristle-covered rim. In this case, the stop means may be designed to be fixed.

It is alternatively or additionally however also feasible that the stop means is adjustable or is designed to be adjusted relative to the bristle-covered rim. The setting can fundamentally be made during its stopper function and also during its abrasive function. In addition, the adjustment of the stop means is naturally also possible in a period between these two functions and is covered by the invention. Usually however the design will be made so that different setting positions of the stop means compared to the bristle-covered rim belong to the two functions described.

The stopper function of the stop means will thus usually be selected so that the stop means dips into the bristle-covered rim with its entire cross-section. As a consequence thereof, the stopper region defined on the surface of the stop means corresponds approximately to half or more than half of the surface. If, on the other hand, the stop means adopts the abrasive function, the stop means dips only partially into the bristle-covered rim with its cross-section. Usually the bristles slide more or less tangentially along the abrasive region upon adopting the abrasive function of the stop means. As a result, the abrasive region can be configured to be relatively small on the surface of the stop means and typically occupies about 10% to 50% of the surface whereas the stopper region corresponds to about 30% to 80% of the surface of the stopper means.

Naturally a combination of both measures can also be accomplished to distinguish between the stopper function on the one hand and the abrasive function on the other hand. In this case, for example, when changing from, for example, the stopper function to the abrasive function (and conversely) not only the direction of rotation of the annular brush is altered but in addition also the position of the stop means. This procedure is preferably adopted. That is, on changing from the stopper function to the abrasive function, the annular brush is stopped with regard to the original rotation in the counterclockwise direction and operated with the opposite direction of rotation in the clockwise direction in order to be able to assume the abrasive function.

At the same time, this reversal of the direction of rotation is associated with the fact that the stop means dips so far from the bristle-covered rim that the bristles pass the abrasive region tangentially during the subsequent abrasive function as has already been described above. The stop means advantageously configured to be adjustable compared to the bristle-covered rim can usually be adjusted radially and/or angularly. An eccentric adjustment of the stop means is quite particularly preferred.

As a result and independently thereof, it is possible to adjust the stop means by the driven bristles. That is, the adjustment of the stop means is not accomplished with an external additional drive but by the bristles themselves effecting the adjustment of the stop means. Usually the design is made so that upon changing from the stopper function to the abrasive function and conversely, the direction of rotation of the annular brush is changed. The reversal of the direction of rotation at the same time has the result that the stop means is reset. For this purpose the stop means is advantageously connected to a side arm that is pivoted on a machine housing. The side arm usually comprises an eccentric side arm.

In addition, the side arm has at least two stops or interacts with two stops. In this case, one stop is used to define the stopper function and another stop to define the abrasive function. The reversal of the direction of rotation of the annular brush accompanying the change of function therefore has the result that the bristles acting on the stop means reset the stop means. The adjusting movement is maintained until the stop means adopts its function setting determined by the direction of rotation, either the stopper function or the abrasive function. Consequently the two stops assigned to the side arm are designated a stopper stop on the one hand and an abrasive stop on the other hand.

The subject matter of the invention is also a rotary brush tool that is equipped with a machine housing and a drive unit for the brush assembly described. In addition, a method for treating a surface of a material with the aid of the brush assembly described is also covered.

As a result, a brush assembly, an appurtenant rotary brush tool and a method for treating a surface of a material with the aid of the brush assembly are described with the aid of which a simple and permanent treatment of the surface is achieved. Comparable depths such as are possible and can be achieved by (sand) blasting are achieved and observed. However, expensive drive devices are omitted and in particular there is no need to dispose of a blasting means. At the same time, particularly high lifetimes are observed because the bristles can be reground. All this is achieved with the aid of the stop means that fulfil a double function, i.e. the stopper function and abrasive function described. The essential advantages can be seen herein.

BRIEF DESCRIPTION OF THE DRAWING

The invention is explained in detail hereinafter with reference to a drawing showing a single embodiment. Therein.

SPECIFIC DESCRIPTION OF THE INVENTION

Figure 1:
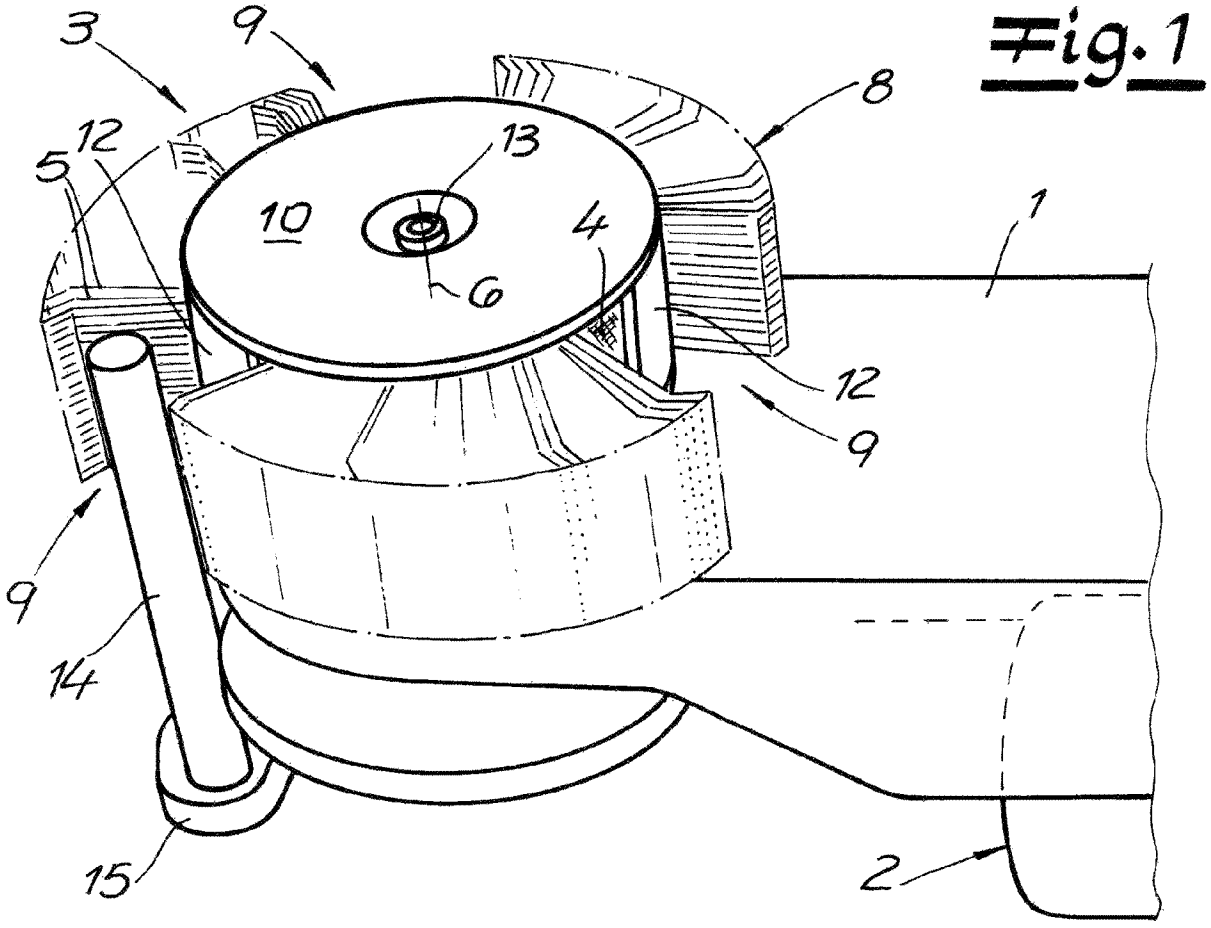
FIG. 1 is a perspective view of the rotary brush tool according to the invention including brush assembly driven thereby.

FIG. 1 shows a rotary brush tool that has a machine housing 1 and a drive unit 2 for a brush assembly 3. The brush assembly 3 has an annular brush 4, 5 that in the illustrated embodiment and not restrictively is composed of a brush strip 4 and bristles 5 connected thereto and projecting outwardly.

It can be seen that the bristles 5 extend radially from a center or axis of rotation 6 and extend substantially perpendicularly on a surface of the annular brush 4, 5 or a surface of the brush strip 4. The bristles 5 are U-shaped, made of steel, and fitted through in holes 7 in the brush strip 4 (cf. FIG. 2). The bristles 5 form a bristle-covered rim 8 with gaps 9. The annular brush 4, 5 is carried by a brush holder 10, 11 rotated by the drive unit 2. In fact, the brush holder 10, 11 is composed of two end disks 10 that are held in a spaced-apart position by a spacer bushing 11. In the present case, the spacer bushing 11 can also be omitted. The brush strip 4 of the annular brush 4, 5 in that case takes on the function of the spacer bushing 11.

It can be further seen from FIG. 1 that the two end disks 10 have axial webs 12 with which they overlap the annular brush 4, 5 or the brush strip 4 at the gaps 9. Both end disks 10 are braced against one another by the interposed spacing bushing 11 or the brush strip 4, 11 including bristles 5 connected thereon. This ensures a secure hold of the annular brush 4, 5 on a drive pin 13 of the drive unit 2 of the rotary brush tool.

Within the framework of the example shown in FIG. 1, there are three angularly equispaced gaps 9 distributed uniformly over the circumference of the brush strip 4. In addition stop means 14 that dips into the rotating bristle-covered rim 8 is provided. The stop means 14 is nonrestrictively a, for example, cylindrical pin 14 that is connected via a side arm 15 to the machine housing 1 of the rotary brush tool. The stop means 14 or the pin 14 extends parallel to the drive pin 13 of the drive unit 2 or parallel to the axis of rotation 6 on the side arm 15 and is connected to this, for example, in a screwed manner. The length of the stop means 14 is here selected so that it substantially corresponds to the width of the brush strip 4, consequently the stop means 14 does not or only insignificantly projects axially past the annular brush 4, 5.

Figure 2:
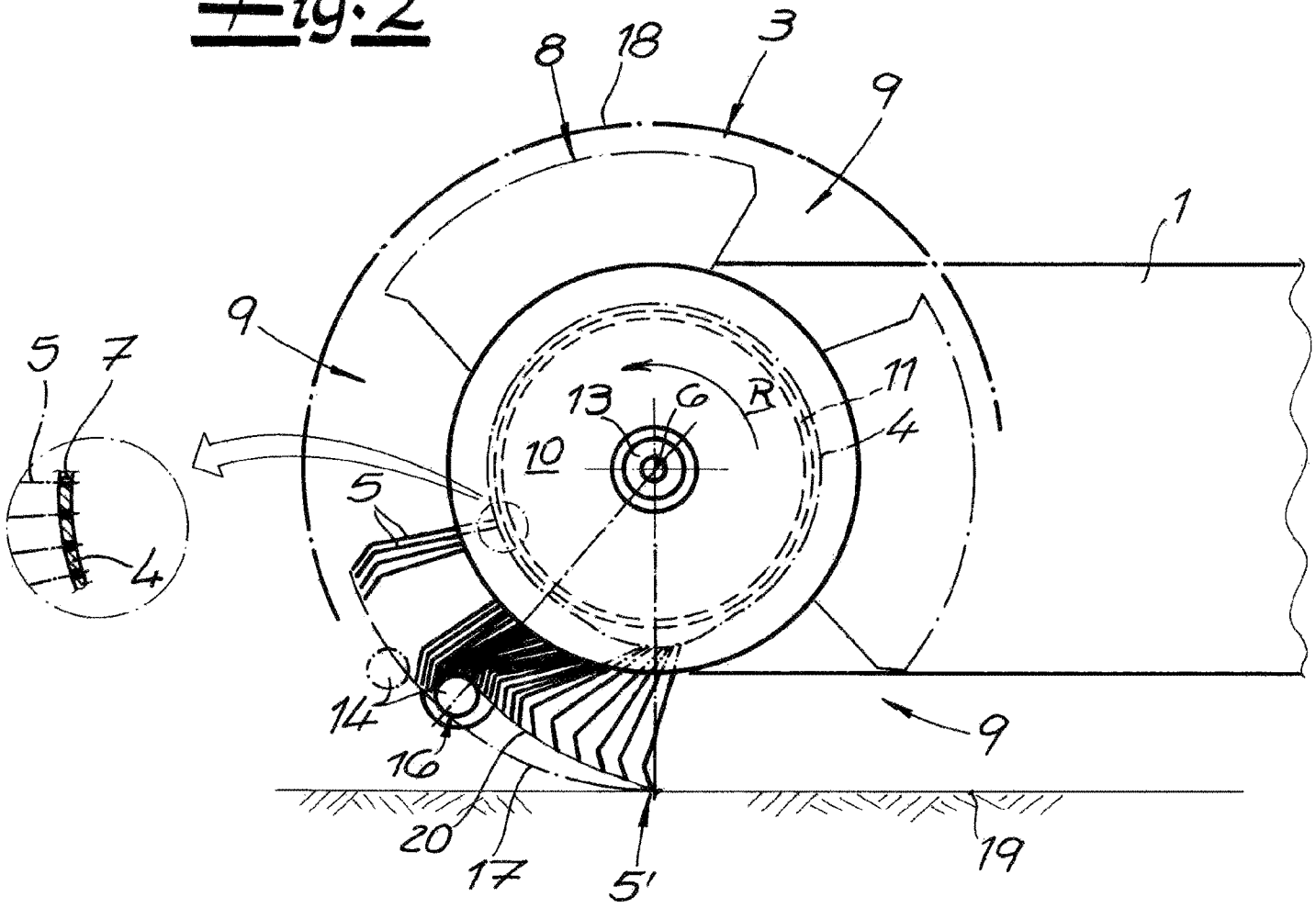
FIG. 2 is a detail view of the brush assembly in operation when implementing the stopper function.
Figure 3:
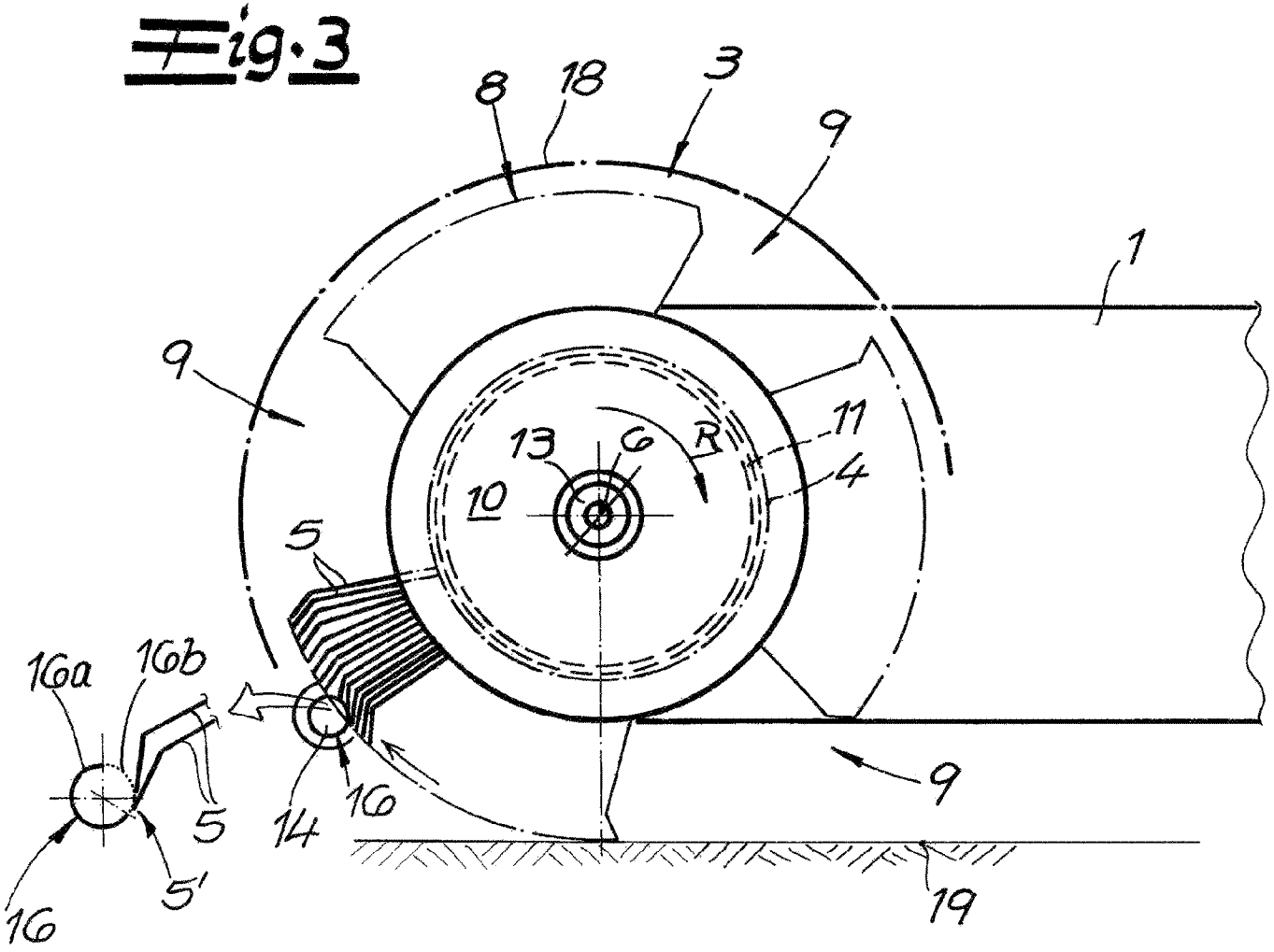
FIG. 3 is a view like FIG. 2, also in operation and specifically in abrasive function.

Within the framework of the invention, the stop means 14 can take on two functions, namely a stopper function as shown in FIG. 2 and also an abrasive function as shown in FIG. 3. That is, the stop means 14 is at the same time configured as an abrasive body for the bristles 5. For this purpose, the outer surface 16 of the stop means 14 designed in this embodiment as a cylinder has two regions. In fact, a stopper region 16*a* on the one hand and an abrasive region 16*b* on the other hand are provided.

The outer surface 16 of the stop means 4 is therefore composed of the stopper region 16*a* and the abrasive region 16*b* that more or less complement each other and usually together form the entire outer surface 16 of the stop means 14. In fact, the stopper region 16*a* occupies about 30% to 80% of the outer surface 16 whereas the abrasive region 16*b* occupies about 10% to 50% of the outer surface 16 of the stop means 14. The stopper region 16*a* and the abrasive region 16*b* are arranged with respect to one another so that they do not overlap but on the contrary adjoin one another with or without spacing. As a consequence, the bristles 5 either interact only with the stopper region 16*a* or only with the abrasive region 16*b*. The stopper function of the brush assembly 3 or the rotary brush tool as a whole belongs to the above-described interaction whereas the last-mentioned interaction corresponds to the abrasive function. The stopper region 16*a* and/or the abrasive region 16*b* can be formed integrally on the stop means 14 or attached additionally hereon. This can be achieved, for example, by screwing on sleeves or plates that define the stopper region 16*a* in question and/or the abrasive region 16*b*.

Insofar as the brush assembly 3 or the rotary brush tool takes on its stopper function according to FIG. 2 and the relevant function setting exists, the stop means 14 operates in principle as has already been described in detail initially in EP 1 834 733 B1 to which reference is made. In this case, the stop means 14 dips into the rotating bristle-covered rim 8 and specifically with its entire cross-section. By reference to FIG. 2 it can be seen that the stopper function corresponds to an counterclockwise rotation of the annular brush 4, 5 about the axis of rotation 6. As a result, the bristles 5 are braked by the stop means 14 for a certain time. When the bristles 5 come free from the stop means 14, the kinetic energy stored by the bristles 5 and/or the brush strip 4 is used for additional impacting treatment of a surface of a material 19 by the bristles 5.

In this embodiment, the bristles 5 have preliminarily angled brush tips 5' in their direction of rotation R indicated by an arrow in the counterclockwise direction according to FIG. 2. This is naturally not compulsory. As soon as the bristles 5 have reached the stop means 14, the bristle strip 4 primarily undergoes a deformation. This is because the bristles 5 that usually stand perpendicularly on the brush strip 4 are forced into an acute-angled position compared to the surface of the brush strip 4. From a certain acute angle the bristle tips 5' can no longer be retained by the stop means 14 so that the bristles 5 snap back and during this process the bristle tips 5' move through the circular arc 20 indicated in FIG. 2 that differs from the outer surface 17 of the bristle-covered rim 8 or the relevant circular arc. A protective hood 18 for the entire brush assembly 3 can also be seen in the relevant figure.

In addition to this stopper function according to FIG. 2, the stop means 14 can however also fulfil an abrasive function according to the diagram in FIG. 3. In contrast to the stopper function according to FIG. 2, the abrasive function corresponds to the annular brush 4, 5 now rotating in the clockwise direction. This is again made clear by the arrow with the direction of rotation R. The change from the stopper function to the abrasive function and conversely therefore corresponds to a reversal of the direction of rotation of the rotating annular brush 4, 5. In addition to this reversal of the direction of rotation, the stop means 14 has undergone a reset as is made clear by a comparison of FIGS. 2 and 3. In fact, the set position of the stop means 14 pertaining to the stopper function is shown as by a solid line in FIG. 2 whereas the setting position pertaining to the abrasive function is reproduced by a dot-dash line.

In other words, switching between the two functions, that is between the stopper function and the abrasive function of the stop means 14 is effected by the direction of rotation R of the annular brush 4, 5 and to change the position of the stop means relative to the bristle-covered rim 8. It can be seen that in order to assume the stopper function the stop means 14 dips into the bristle-covered rim 8 with its entire cross-section or its entire outer surface 16 (cf. FIG. 2). On the other hand, the abrasive function according to FIG. 3 corresponds to the fact that the stop means 14 only dips partially into the bristle-covered rim 8 with its cross-section or outer surface 16.

In fact, the stop means 14 in the abrasive function only dips into the bristle-covered rim 8 with its abrasive region 16*b*. As a result, the bristles 5 or their bristle tips 5' move more or less tangentially past the stop means 14 in the abrasive function. In this way the bristles 5 at their bristle tips 5' are treated abrasively on their rear side when viewed in the working direction. This is naturally to be understood merely as an example, where the bristles 5 can in principle also be treated abrasively over a greater length.

Figure 4:
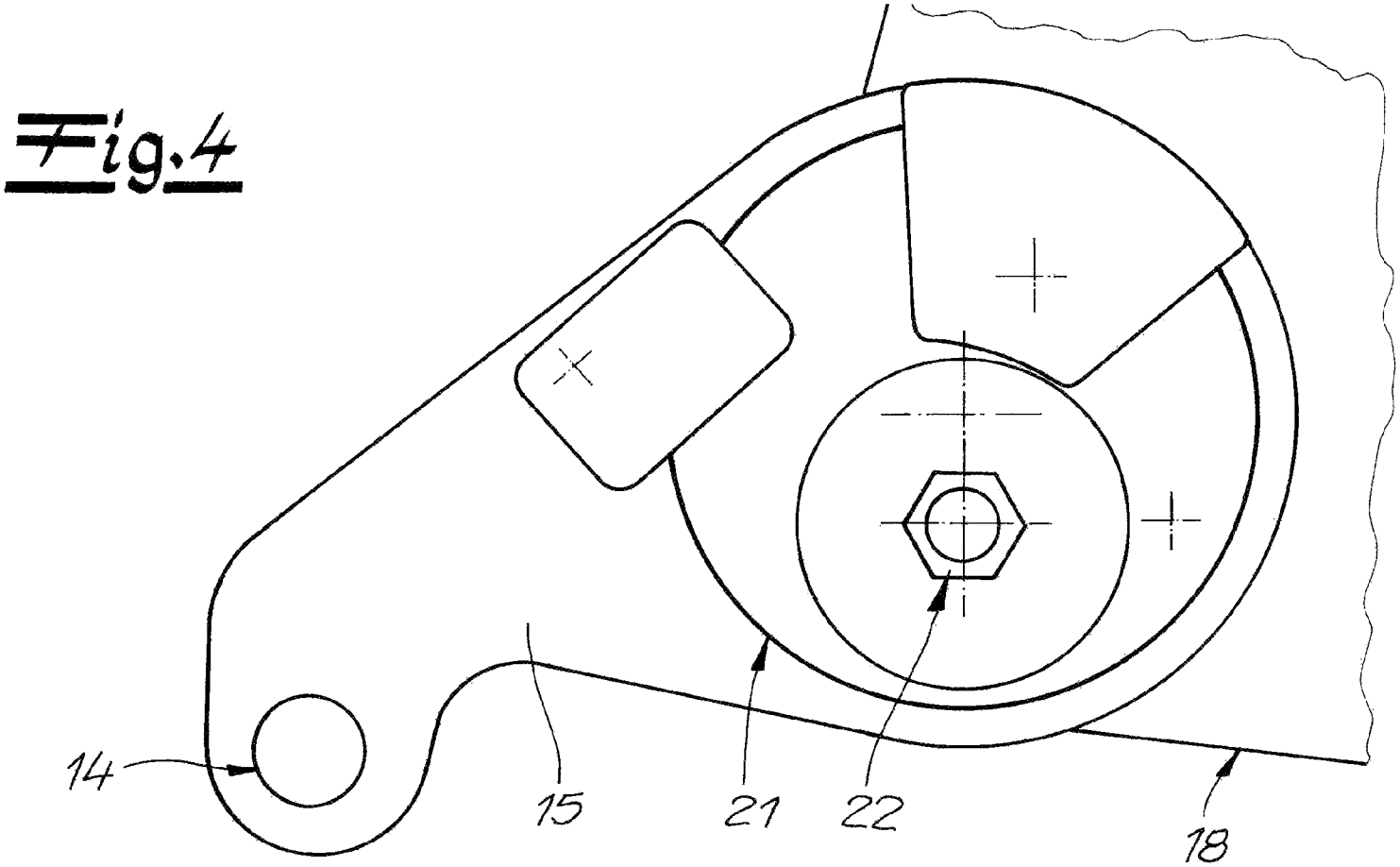
FIGS. 4 and 5 are end and side views that show the side arm for attachment of the stop means.

A comparison of FIGS. 2 and 3 with the relevant function settings makes it clear that the stop means 14 is adjusted radially and angularly. In fact, the stop means 14 undergoes an eccentric adjustment. For this purpose the stop means 14 is connected to the side arm 15 that for its part is pivoted on the machine housing 1. As is evidenced by the diagram according to FIGS. 4 and 5, the side arm 15 is eccentric. This eccentric side arm 15 is equipped with a bearing eye 21 through which a bearing bolt or a bearing plate 22 passes eccentrically. The bearing plate or the bearing bolt 22 is connected to the machine housing 1. With respect to this the eccentric side arm 15 can execute an eccentric pivoting movement that is indicated in FIG. 2, if the stopper function shown by the solid line is compared with the abrasive function shown by the dot-dash line. Corresponding diagrams are found in FIG. 5. Here the pivoting movement of the stop means or pin 14 is indicated at the same time by arrows. Here the position of the stop means or pin 14 shown by the solid line corresponds to the stopper function whereas the dot-dash representation of the stop means 14 corresponds to the abrasive function and shows the appurtenant function setting of the stop means 14 pictorially.

Figure 5:
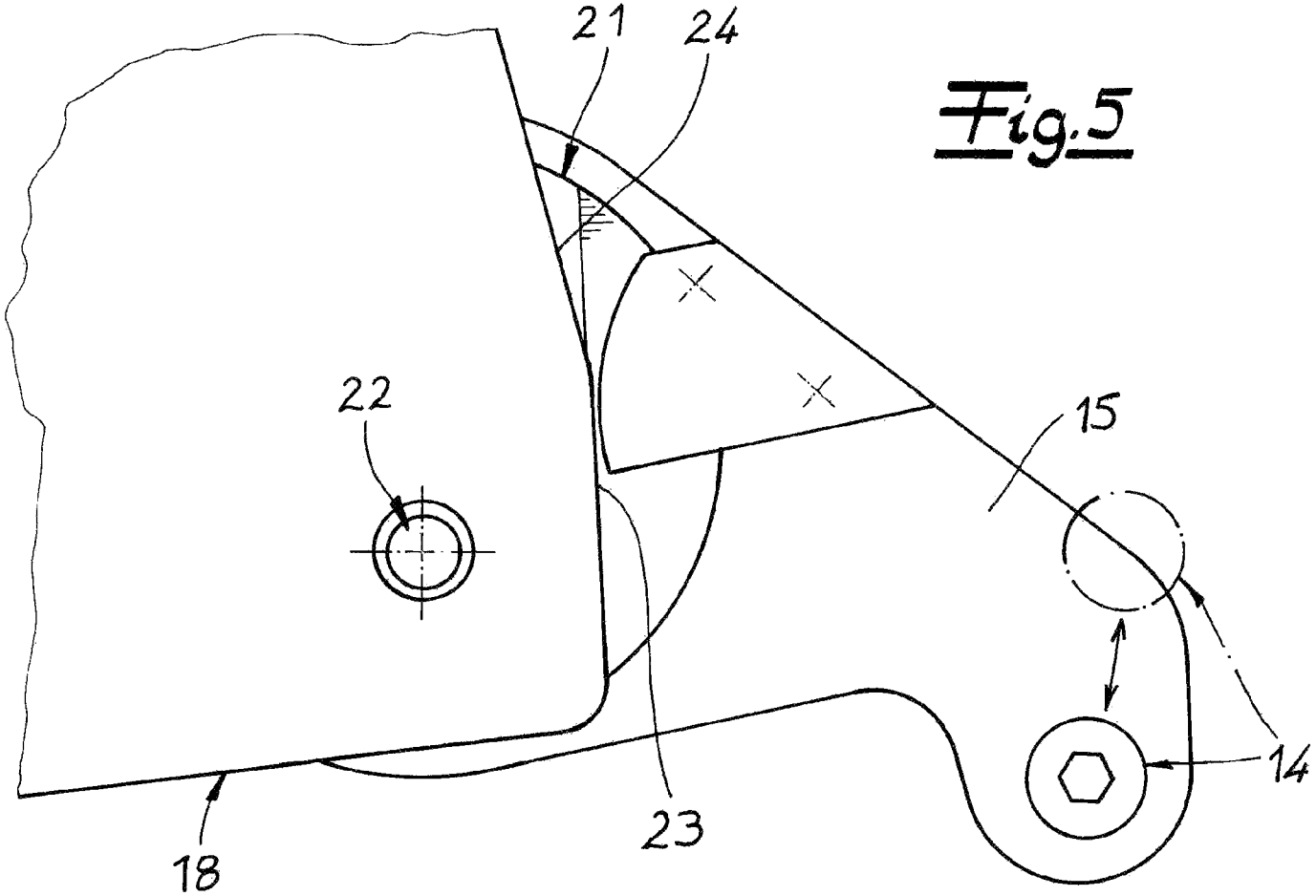

A respective stop 23, 24 that can best be seen in the rear view of the side arm 15 corresponding to FIG. 5 belongs to both functions or function settings. The stopper stop 23 ensures that the side arm or eccentric side arm 15 assumes the stopper function or the function setting pertaining to this. The abrasive stop 24 on the other hand ensures that the stop means 14 defines the abrasive function or the function setting pertaining to this.

The change from the stopper function to the abrasive function and conversely is accomplished in each case with the aid of the driven bristles 5. That is the stop means 14 is positioned by the driven bristles 5 or the driven annular brush 4, 5. This adjustment with the aid of the rotating annular brush 4, 5 or the bristles 5 approaching the stop means 14 takes place until the relevant setting movement is either limited by the stopper stop 23 or by the abrasive stop 24.

That is, the stop means 14 is transferred into the stopper function or the abrasive function by the bristles 5 running toward it according to the direction of rotation of the annular brush 4, 5. The change from the stopper function to the abrasive function and conversely is accomplished in such a manner that the direction of rotation of the annular brush 4, 5 is changed. The annular brush 4, 5 therefore undergoes a change in the direction of rotation. The stop means 14 is also adjusted by the change in the direction of rotation R of the annular brush 4, 5. This is because the bristles 5 move against the stop means 14 and pivot it relative to the machine housing 1. This process takes place until the corresponding stop 23, 24 blocks further pivoting of the stop means 14.

This means when applied to this embodiment that within the framework of the stopper function according to FIG. 2 the brush assembly 3 rotates the annular brush 4, 5 in the counterclockwise direction according to the direction of the arrow R in FIG. 2. In this process the bristles 5 engage the stop means 14 and the stop means 14 is held in the position shown by the solid line by the side arm 15 and the appurtenant stopper stop 23. The stop means 14 can consequently take over and fulfil the stopper function described, as has already been described.

If the unit is now to be switched from the stopper function according to FIG. 2 to the abrasive function according to FIG. 3, it is merely necessary to drive the annular brush 4, 5 taking into account a reversal of the direction of rotation not in the counterclockwise direction but rather in the clockwise direction as shown in FIG. 3. As a consequence of this, the stop means 14 is acted upon by a force in the clockwise direction and pivoted with respect to the machine housing 1. This process continues until the position indicated by the dot-dash line in FIG. 2 is reached. This dot-dash position is shown in FIG. 5. The dot-dash position according to FIGS. 2 and 5 corresponds to the abrasive function and is shown by a solid line in FIG. 3. A further pivoting movement of the stop means 15 beyond the set position according to FIG. 3 is not possible because the side arm 15 now abuts the abrasive stop 24. In this position the bristles 5 can now be "sharpened."

This is because in the abrasive function the bristles 5 or their bristle tips 5' slide more or less tangentially along the abrasive region 16*b* of the outer surface 16 of the stop means 14 that is additionally shown in enlarged view in FIG. 3. This abrasive region 16*b* may have an abrasive coating or has been treated in such a manner that the bristle tips 5' undergo a relief-grinding treatment on their rear side when viewed in the working direction or clockwise direction in the exemplary case. After completion of the abrasive work, it is easily possible to switch to the stopper function. To this end, the annular brush 4, 5 must merely execute another reversal of the direction of rotation.

As a consequence of this, the annular brush 4, 5 is again rotated in the counterclockwise direction as shown in FIG. 2. This reversal of the direction of rotation has the result that the bristles 5 press against the stop means 14 with a force in the counterclockwise direction. Consequently, the stop means 14 is transferred from its solid-line position according to FIG. 3 or the dot-dash position in FIG. 2 into the position shown by the solid line in FIG. 2. This takes place until the side arm 15 reaches the stopper stop 23. The stopper stop 23 prevents further movement of the side arm 15 in the same direction.

The possibility of connecting the protective hood 18 and/or the side arm 15 to the stop means 14 adjustably to the machine housing 1 is not expressly shown. In fact, the protective hood 18 and/or the side arm 15 may be fitted with mounts that enable a different and detachable fixing to the machine housing 1. In this connection, the protective hood 18 and/or the side arm 15 and/or the annular brush 4, 5 can be designed to be stretchable and fixed in different stretching positions.

The invention claimed is:

1. A brush assembly comprising:

a housing;

a brush holder centered on and rotatable about a brush axis on the housing;

a multiplicity of bristles projecting generally radially from the brush holder;

a reversible drive connected to the holder for rotating the holder about the brush axis in a clockwise direction and in an opposite counterclockwise direction;

an arm having an inner end pivoted on the housing about an arm axis offset from and parallel to the brush axis and an outer end generally radially level with the tips of the bristles; and a stop rod projecting from the outer end parallel to the brush axis and arm axis and having an outer surface engageable with the tips of the bristles as the holder rotates in clockwise or counterclockwise direction, the outer surface having a portion provided with abrasive and extending angularly over between 10% and 50% of the outer surface and adjacent thereto another stopper portion that extends angularly over between 30% and 80% of the outer surface, the abrasive portion being engaged by the bristles only on rotation in one of the clockwise and counterclockwise directions and the stopper portion being engaged by the bristles only in the other of the clockwise and counterclockwise directions, whereby the rod abrades and sharpens the tips on rotation of the brush holder in the one clockwise or counterclockwise direction and as a stop on rotation of the brush holder in the other clockwise or counterclockwise direction.

2. The brush assembly defined in claim 1, wherein the bristles extend substantially radially of the brush axis from the holder except when engaging the stop rod and the tips of the bristles are angled rearward on rotation of the holder in the other clockwise or counterclockwise direction.

3. The brush assembly defined in claim 2, further comprising:

a plurality of stops defining for the arm a pair of end positions that are angularly opposite each other, the stops and axes being relatively positioned such that on movement of the arm from engagement with one of the stops to the other of the stops the stop rod moves radially and angularly relative to the brush axis between a radially inner position and a radially outer position, the arm being freely shiftable between the end positions and moved between the end positions depending on the rotation direction of the brush holder and being shifted by the brush holder into the inner position when rotating in the other clockwise or counterclockwise direction.

4. The brush assembly according to claim 1, further comprising:

stop means configured to be adjustable compared to the bristle-covered rim.

5. The brush assembly according to claim 4, wherein the stop means is configured to be radially or tangentially adjustable.

6. The brush assembly according to claim 4, wherein the stop means is designed to be eccentrically adjustable.

7. The brush assembly defined in claim 1, wherein the radially outer position corresponds to the one end position engaging the abrasive.

8. The brush assembly according to claim 1, wherein the arm has at least two stops for defining a stopper position and for defining an abrasive position.

* * * * *